United States Patent [19]

Scott

[11] Patent Number: 4,798,557

[45] Date of Patent: Jan. 17, 1989

[54] CAMISOLE UNDERWIRE BRA GARMENT

[76] Inventor: Lucretia M. Scott, 12633 Burbank Blvd., #208, North Hollywood, Calif. 19607

[21] Appl. No.: 99,855

[22] Filed: Sep. 22, 1987

[51] Int. Cl.[4] ..... A41C 3/08

[52] U.S. Cl. ..... 450/31; 450/7; 450/11; 450/30; 450/41; 450/47; 450/48; 450/52; 2/73

[58] Field of Search ..... 2/73; 450/7, 11, 30, 450/31, 41, 47, 48, 52, 67, 109

[56] References Cited

U.S. PATENT DOCUMENTS

| | | | |
|---|---|---|---|
| 2,290,954 | 7/1942 | Fox | 2/71 |
| 2,510,012 | 5/1950 | Edelman | 450/52 |
| 2,558,420 | 6/1951 | D'Amato | 2/73 |
| 3,343,545 | 9/1967 | Kress | 128/454 |
| 3,565,081 | 2/1971 | Barg | 128/454 |

FOREIGN PATENT DOCUMENTS

| | | | |
|---|---|---|---|
| 285757 | 1/1953 | Switzerland | 2/73 |

*Primary Examiner*—Werner H. Schroeder
*Assistant Examiner*—Jeanette E. Chapman
*Attorney, Agent, or Firm*—Henderson & Sturm

[57] ABSTRACT

A camisole underwire bra garment (10) including a camisole unit (11) and an underwire bra unit (12) whose upper portions (11') and (12') share the same general contour and configuration, wherein the underwire bra unit (12) is only connected to the camisole unit (11) along their respective upper portions to produce a camisole garment (10) that provides lift and support for a woman's breasts.

5 Claims, 2 Drawing Sheets

FIG. 1.
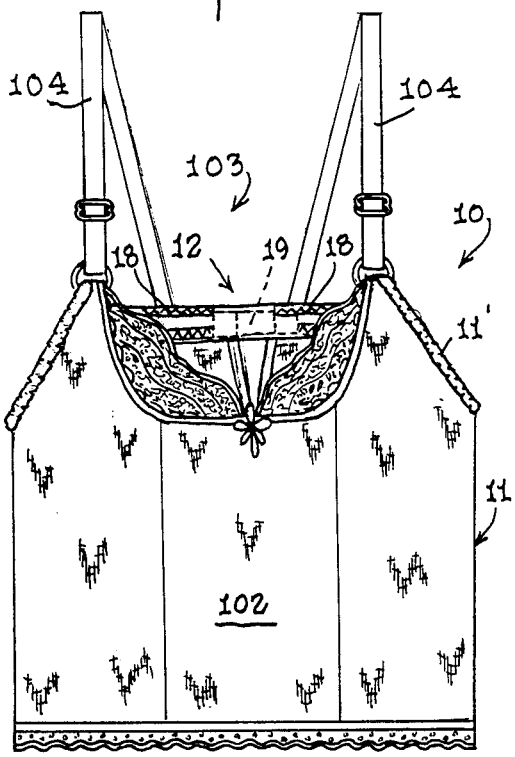
FIG. 2.
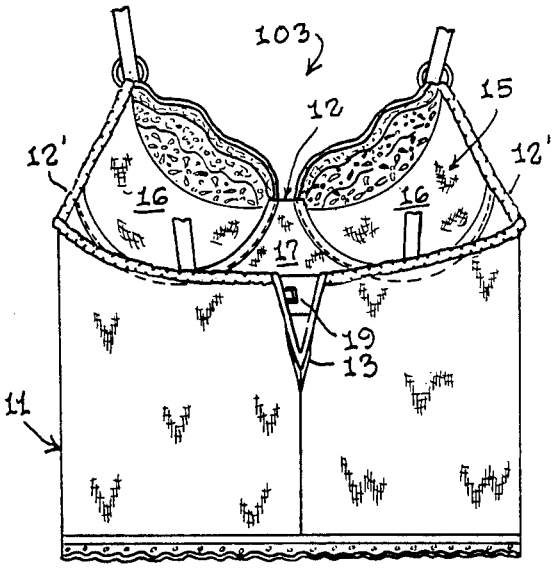
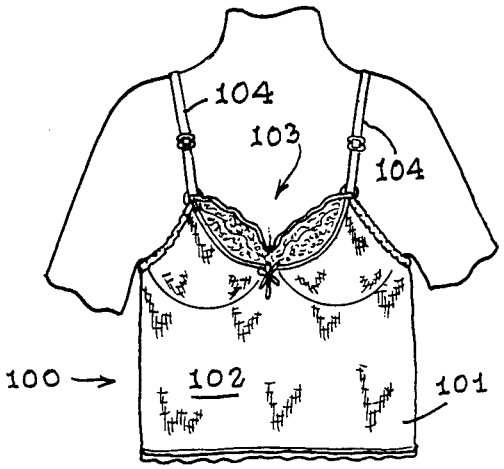
FIG. 3.
PRIOR ART
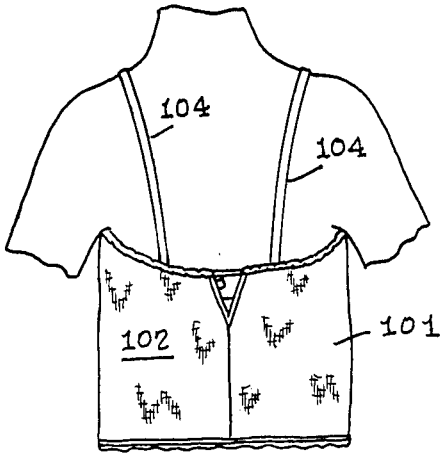
FIG. 4.
PRIOR ART

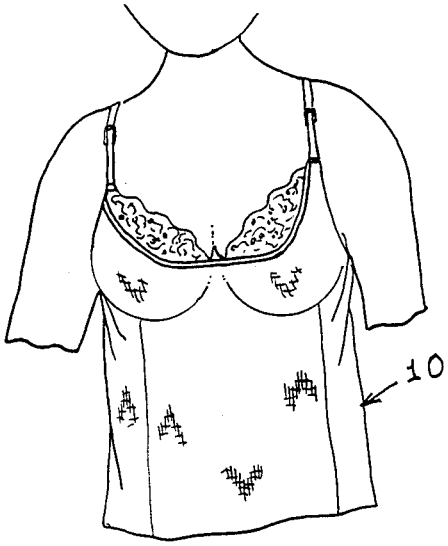
FIG. 5.
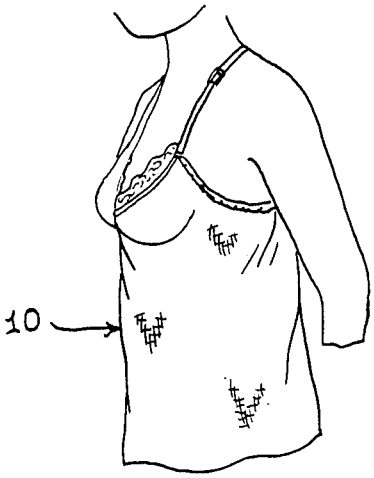
FIG. 6.
FIG. 7.
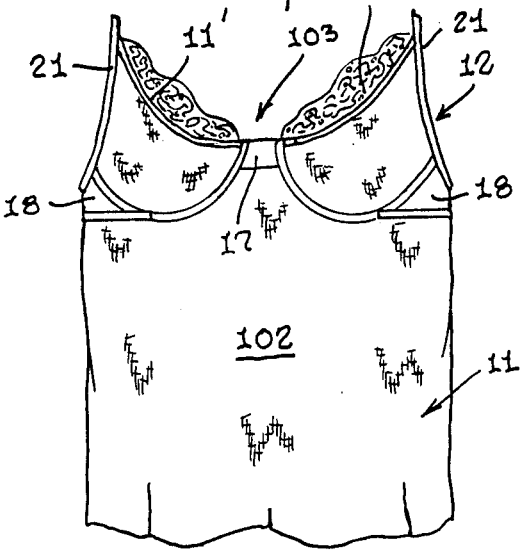
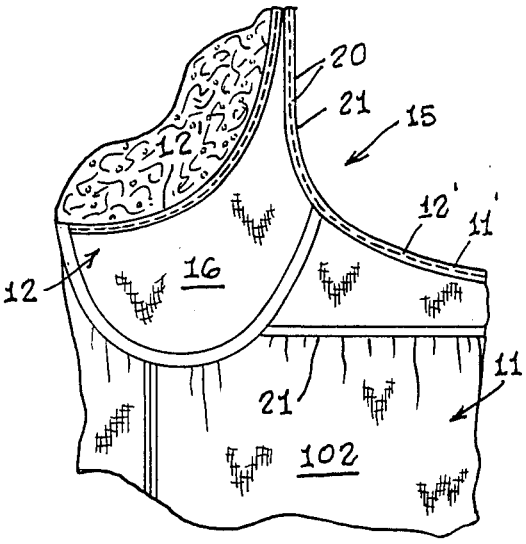
FIG. 8.

CAMISOLE UNDERWIRE BRA GARMENT

TECHNICAL FIELD

The present invention relates generally to the field of feminine undergarments, and more specifically to undergarments having a built in support means.

BACKGROUND OF THE INVENTION

As can be seen by reference to the following U.S. Pat. Nos. 3,343,545; 2,558,420; 2,290,954; and 3,565,081, the prior art is replete with myriad and diverse undergarments having a built in support means.

It should also be noted that a typical camisole construction offers virtually no support whatsoever for the wearer. As a consequence of the foregoing situation, most women will only wear a camisole under certain outerwear garments which are generally loose fitting, and will resort to the prior art brassiere and bra-slip constructions when more closely fitted outerwear garments are to be worn.

Up until the present time when a woman wished to wear a camisole due to its loose fitting nature and she still required support for her breasts, she was required to wear a bra underneath her camisole to achieve the desired results, if not the desired effect, from both a fashionable and an aesthetically pleasing standpoint.

While a limited number of women due to their physical busts, youth, and/or physical fitness do not require or desire support for their breasts while wearing a camisole, the vast majority of women both need and require the support that is not to be found in a standard camisole construction.

Based on the foregoing situation there has existed long standing need in the fashion industry and particularly among the manufacturers of womens intimate apparel for a garment that could combine the comfort and fit of a camisole with the support and uplift of a brassiere.

SUMMARY OF THE INVENTION

The present invention comprises in general the combination of a brassiere construction with a camisole construction, and in particular, the incorporation of an underwire bra unit into a typical camisole unit to produce a camisole underwire bra garment.

In addition, the camisole underwire bra garment of the present invention involves the physical attachment of the underwire bra unit to the camisole unit only along the upper periphery of both units, wherein the underwire bra unit is virtually suspended from the top of the camisole unit along a single common edge.

Furthermore, the camisole underwire bra garment of this invention utilizes the closure means of the underwire bra unit to produce a snug fit of the garment around the user's upper torso while the camisole unit hangs loosely around the user's mid-torso in the usual fashion of a typical camisole.

As a result of the unique construction of the camisole underwire bra garment of this invention, a woman can have the support and lift of an underwire bra while still maintaining the loose fit of a camisole in a single item of intimate apparel.

BRIEF DESCRIPTION OF THE DRAWINGS

These and other objects, advantages and novel features of the invention will become apparent from the detailed description of the best mode for carrying out the preferred embodiment of this invention which follows, particularly when considered in conjunction with the accompanying drawings wherein:

FIG. 1 is a front plan view of the camisole underwire bra garment of this invention;

FIG. 2 is a rear plan view of the garment;

FIG. 3 is a front view of a woman wearing a prior art camisole;

FIG. 4 is a rear view of a woman wearing a prior art camisole;

FIG. 5 is a front view of a woman wearing the garment of this invention;

FIG. 6 is a side view of a woman wearing the garment;

FIG. 7 is a front plan view of the garment turned inside out; and,

FIG. 8 is an enlarged detail view of the garment interior.

BEST MODE FOR CARRYING OUT THE INVENTION

As can be seen by reference to the drawings and in particular to FIG. 1, the camisole underwire bra-garment that forms the basis of the present invention is designated generally by reference numeral (10). The garment (10) comprises in general a camisole unit (11) and an underwire bra unit (12). These units will now be described in seriatim fashion.

Prior to embarking upon a description of the preferred embodiment of the garment (10) of this invention, it should be noted that a prior art typical camisole construction (100) is depicted in FIGS. 3 and 4, and labeled accordingly. As shown in FIGS. 3 and 4, the prior art camisole construction (100) comprises a generally loose fitting sleeveless tubular covering (101) fabricated from a single layer of material (102) and having a generally scooped neck (103) and a plurality of strap elements (104) for supporting and suspending the tubular covering (103) from a woman's shoulders.

As can be seen by reference to FIGS. 1 and 2, the camisole unit (11) of this invention shares many structural features in common with the typical prior art camisole constructions in that the camisole unit (11) is fabricated from a single layer of material (102) and is also provided with a generally scooped neck (103) and a plurality of camisole strap elements (104) for supporting and suspending the camisole unit (11) from a woman's shoulders.

However, as can best be seen by reference to FIG. 2, the primary difference between the standard camisole construction (100) and the camisole unit (11) of the present invention involves an elongated slit (13) formed in the back panel (14) of the camisole unit (11). The purpose and function of this slit tubular construction will be explained in greater detail further on in the specification.

As shown in FIGS. 1, 2, 7, and 8, the underwire bra unit (12) of this invention comprises an underwire bra member (15) including a pair of underwire bra cup elements (16) operatively connected to one another by an intermediate bra segment (17), wherein each of the bra cup elements (16) are provided with elasticized torso encircling bra strap members (18) provided with cooperating securing means (19) to snugly engage the underwire bra member (15) around a woman's upper torso.

As can best be seen by reference to FIGS. 2, 7, and 8, the contour of the upper portion (12') of the underwire bra unit (12) is configured to conform to the contour of the upper portion (11') of the camisole, such that the camisole unit (11) will be operatively secured to the underwire bra unit (12) such as by stitching (20) along their common upper portions (11')(12'), wherein the underwire bra unit (12) will essentially be suspended along its upper edge from the camisole unit (11).

As mentioned previously in the specification, the bra strap members (18) are elasticized, wherein the upper and lower edges of each bra strap is provided with a strip (21) of elastic material. In addition, the strips (21) of elastic material on the upper edges of the bra strap members (18) project beyond the strap members (18) and extend along the tops of both bra cup elements (16) to the point where the bra cups (16) are operatively attached to the camisole strap members (104).

Since the camisole unit (11) is attached to the upper elasticized strips (21) of the underwire bra unit (12) the upper portion of the camisole unit (11) will be slightly bunched by the physical attachment to the elastic material prior to the garment (10). However, once a woman places the garment (10) on her body and engages the bra strap securing means (19) in a well recognized fashion, the bunching of the camisole material will disappear. In addition, the opposed edges of camisole slit (13) will be brought into close proximity to one another such that the rear panel of the camisole unit (11) will closely approximate the appearance of the prior art camisole depicted in FIG. 4.

As can best be appreciated by reference to FIGS. 3 thru 6, since the prior art camisole construction (100) offers a woman absolutely no support, the woman's breasts will spread and sag to their natural unfettered position as indicated in phantom in FIGS. 3, 5, and 6. However, when a woman is wearing the camisole garment (10) of the present invention, the underwire bra unit (12) will lift and support the woman's breasts in a well recognized manner to noticeably improve her appearance.

It should also be noted at this juncture that while the woman will actually be wearing the camisole garment (10) of this invention, she will appear to be wearing a prior art camisole construction (100) since the camisole material (102) will be hanging loosely around her torso, and the underwire bra unit (12) will not be visible nor apparent even upon close scrutiny by someone other than the woman wearing the garment.

Having thereby described the subject matter of this invention it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A camisole underwire bra garment comprising:

a camisole unit having a generally scooped neck and a plurality of camisole strap elements; and an underwire bra unit including a pair of underwire bra cups operatively attached to one another wherein the bra cups are provided with at least one bra strap member for encircling the underwire bra unit around a woman's chest, and wherein the upper portion of the underwire bra unit is only operatively attached to the upper portion of the camisole unit along the edges of their common upper portions whereby the camisole unit is suspended from the upper portion of said underwire bra unit.

2. The garment as in claim 1, wherein the camisole unit is provided with an elongated slit.

3. The garment as in claim 2, wherein the underwire bra unit is provided with cooperating securing means for securing the said bra unit around a woman's chest.

4. The garment as in claim 3, wherein the securing means on said bra unit are adapted to bring the opposed edges of the elongated slit in said camisole unit into close proximity with one another.

5. The garment as in claim 1, wherein the contour of the upper portion of the underwire bra unit and the contour of the upper portion of the camisole unit are configured generally the same.

* * * * *